US005210960A

United States Patent [19]

LaRue

[11] Patent Number: 5,210,960

[45] Date of Patent: May 18, 1993

[54] LINT FILTER

[76] Inventor: Len LaRue, 6970 Pembroke Dr., Reno, Nev. 89502

[21] Appl. No.: 944,532

[22] Filed: Sep. 14, 1992

[51] Int. Cl.[5] ..... F26B 21/06

[52] U.S. Cl. ..... 34/82; 34/86; 34/235

[58] Field of Search ..... 34/86, 235, 35, 82, 34/80

[56] References Cited

U.S. PATENT DOCUMENTS 4,395,831 8/1983 Nielsen ..... 34/235 X 4,434,564 3/1984 Braggins, Jr. ..... 34/235 X

*Primary Examiner*—Henry A. Bennett

[57] ABSTRACT

A lint filter having a container provided with a drawer. A fitting is associated with the container for connecting a hose from a clothes dryer and the like to the container while at least one aperture is provided adjacent the fitting for permitting air carrying the lint into the container to escape therefrom, a baffle is disposed within the container in order to form a flow path for the air and lint through a filter causing the lint to adhere thereto. A rotating filter and a stationary wiper blade are means for cleaning the filter.

5 Claims, 2 Drawing Sheets

LINT FILTER

BACKGROUND OF THE INVENTION

1. Field of the Invention

This invention relates generally to a lint filter and particularly to a lint filter for filtering lint from a stream of air emanating from a clothes dryer and the like.

2. Description of Prior Art

A problem commonly encountered with the use of the conventional clothes dryer and the like is the disposal of lint separated from the clothes during the drying process. Frequently the exhaust gases from the dryer, together with the lint, dust particles, and the like, are merely dispersed into the atmosphere. Many of these known devices require water in a container without maintaining a water level, thus causing back pressure at times or too much clearance letting lint escape to the atmosphere.

U.S. Pat. No. 4,969,276, filed Sep. 27, 1989 by Robert Walsh discloses an air filter and humidifier combined using a water container causing maintenance problems. Further the device disclosed in U.S. Pat. No. 5,052,127, filed Sep. 21, 1990 consists of a lint bag to catch the line after cleaning the inner bag filter. It is reusable. The bag would need to be cleaned after each load to be effective, that being an inconvenience to keep it cleaned. Further in U.S. Pat. No. 2,825,148, issued Mar. 4, 1958, to E. C. Olsen, comprising a lint filter to trap the lint but which uses water in cleaning the filter—thus using an outside water supply along with drain pipes—making it not compactable. Further U.S. Pat. No. 4,905,340, filed Aug. 11, 1988 by Alan Gutschmit, a lint control apparatus more for industrial use has no easy means for cleaning. U.S. Pat. No. 3,111,018, issued Nov. 19, 1963 to J. J. Bonner and U.S. Pat. No. 4,115,485, issued to Richard J. Genessi: Both patents are using water to trap the lint.

SUMMARY OF THE INVENTION

It is an object of the present invention to provide a lint filter that allows free passage of air or other fluid from a clothes dryer and the like, thus eliminating back pressure to the dryer.

It is yet another object of the present invention to provide a lint filter that is independent and does not require water.

It is yet another object of the present invention to provide a lint filter completely self-contained, requiring very little maintenance.

It is yet another object of the present invention to provide an affordable lint filter.

These and other objects are achieved, according to the present invention, by providing a lint filter having a container, a fitting provided on the container for connecting a hose to the container and placing the hose in communication with the container located inside the container and below the fitting a baffle is installed for deflecting air and lint from the dryer to form a flow path through the filter and associated apertures. As air passes through the filter lint and particulate matter are adhering to the filter, thus clean air escapes to the atmosphere. Means for cleaning filter are as follows: Said filter being circular with a shaft solidified to the center of said filter, said shaft protruding through the container and associated apertures, a knob on the outside of the container is attached to the protruding shaft, said knob being the means for rotating the filter, a shaft protruding from the back side of the filter is means for supporting the upper end of a wiper blade, said blade being vertical and stationary and being anchored at the lower end to the container, wiper blade means contacting the filter to loosen the particulate matter, the knob means for rotating the filter and the wiper blade means for loosening and gathering the particulate matter, a gravitational drop occurs, disposing the particulate matter into a cleanout drawer located in the lower housing of the container.

BRIEF DESCRIPTION OF THE DRAWINGS

FIG. 1 is a partial schematic, perspective view showing showing a lint filter, according to the present invention, connected to a conventional clothes dryer and the like.

DESCRIPTION OF PREFERRED EMBODIMENTS

Figure 1:
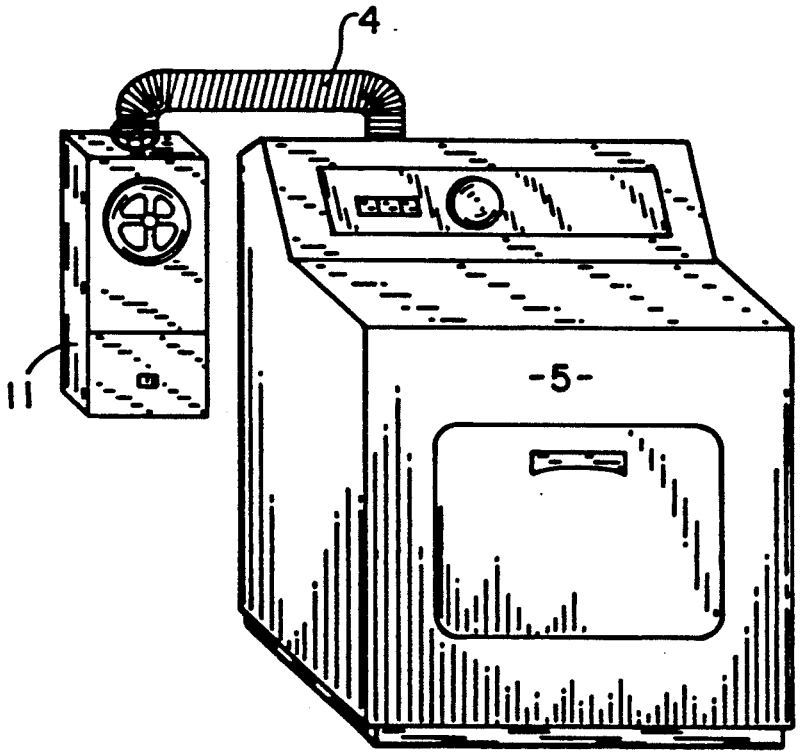

Referring now more particularly to FIG. 1 of the drawings, a lint filter 11, according to the present invention, is shown attached to a conventional clothes dryer 5 as by a length of standard vent hose 4. It is to be understood that although lint filter 11 is shown as having a substantially rectangular or cubical shape, the outer casing of a lint filter can assume any shape or form with the important feature of the invention being the manner in which the filter, wiper blade and the cleaning mode is used and to be able to discharge nothing but clean air and the like.

Figure 2:
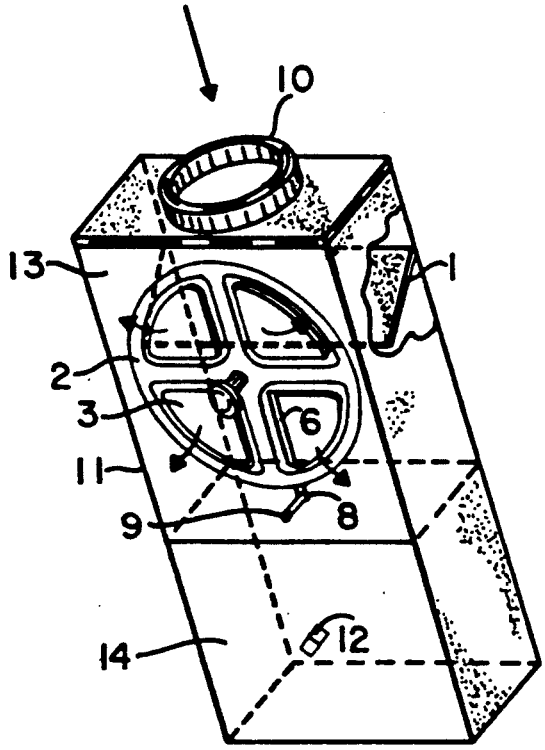
FIG. 2 is a full perspective view and the newly arranged lint filter and lint disposal drawer.
Figure 3:
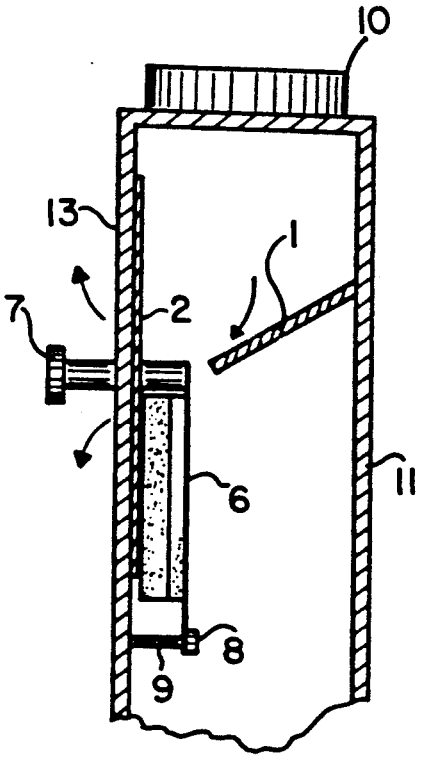
FIG. 3 is a sectionalized side view showing air flow direction and upper section containing disc filter and stationary wiper blade.
Figure 4:
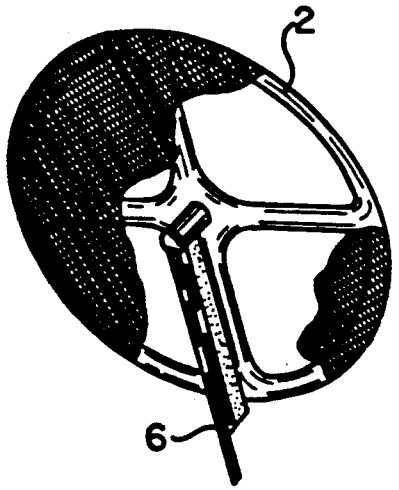
FIG. 4 is a view of the rotating disc filter and stationary wiper blade only.

Referring now more particularly to FIG. 2 through FIG. 4 of the drawings lint filter 11 includes the housing, neck 10 of the housing 11 for connecting a vent house 4, as in FIG. 1, to the housing 11 and placing the hose 4 in communication with the housing 11. One baffle 1 is provided in the upper portion of the housing 11. The baffle 1 is arranged with the housing 11 for directing a flow path through the filter 2 and out four apertures 3, the disc filter 2 having a shaft protruding through the face plate 13 and connecting to a knob 7, a wiper blade 6 which is attached at one end to the backside shaft on the filter 2, the wiper blade 6 being in a vertical and stationary position extending downwardly and attached at the lower end to the face plate 13 by means of a spacer 9 and adjuster nut 8, moving parts being the disc filter 2 rotated by means of the knob 7 manually operated, thus allowing the wiper blade 6 which is in contact with the filter 2 assuring the lint not showing to coagulate, then dispose itself in the cleanout drawer 14 located in the lower housing 11.

As can be readily understood from the above description and from drawings, a lint filter according to the present invention provides optimum flow through the filter, eliminating back pressure on the associated dryer, while materials used for constructing the invention can vary. Any metal, synthetic resin, wood and the like may be employed to fabricate the device.

The foregoing is considered as illustrative only of the principles of the invention. Further since numerous modifications and changes will readily occur to those skilled in the art, it is not desired to limit the invention to exact construction and operation shown and described, and, accordingly, all suitable modifications and equivalents may be resorted to falling within the scope of the invention.

I claim:

1. A lint filter in combination with a dryer having an air circulation system, said system having an exhaust blower and a discharge vent comprising; a chamber, said chamber having an input vent, means to attach said input vent of said chamber to said discharge vent of said dryer, a baffle, said baffle being disposed within said chamber forming first and second compartments, said second compartment being located below said first compartment, said second compartment having means to remove accumulated materials, said first compartment having an exhaust vent, a disc filter, means to rotateably mount said disc filter in a working relationship with said exhaust vent, a wiper blade, said wiper blade having mounting means, said wiper blade being in communication and having a working relationship with said disc filter, said wiper blade being substantially mounted in a vertical position in relationship to said disc filter, means to rotate said disk filter, whereby, when exhaust air from said exhaust blower of said dryer is directed into said input vent of said chamber of said lint filter, said baffle directs said exhaust air thru substantially the top half of said disc filter and when said disc is rotated, said wiper blade wipes material accumulated on said disc filter into said second compartment.

2. The lint filter of claim 1 in which said means to attach said input vent of said chamber to said discharge vent of said dryer is a flexible hose.

3. The lint filter of claim 1 in which said means to remove accumulated material is a drawer.

4. The lint filter of claim 1 in which said means to rotatably mount said disc filter in a working relationship with said exhaust vent is a hand knob and shaft, said knob being affixed to a center portion of the outside of said disc filter, said shaft being affixed to said disc filter at one of its ends on the inside of said disc filter, said shaft having journaling means to said chamber.

5. The lint filter of claim 1 in which said mounting means of said wiper blade are bolts and nuts.

* * * * *